US005564967A

United States Patent [19]

Jorgensen

[11] Patent Number: 5,564,967

[45] Date of Patent: Oct. 15, 1996

[54] METHOD FOR SHARPENING A CHIPPER KNIFE

[76] Inventor: Ray B. Jorgensen, 18562 Wallingford Ave. North, Seattle, Wash. 98133

[21] Appl. No.: 406,083

[22] Filed: Mar. 17, 1995

Related U.S. Application Data

[63] Continuation-in-part of Ser. No. 58,866, May 10, 1993, Pat. No. 5,409,047.

[30] Foreign Application Priority Data

Nov. 4, 1994 [CA] Canada ..... 2135146

[51] Int. Cl.[6] ..... B24B 1/00

[52] U.S. Cl. ..... 451/45; 144/364

[58] Field of Search ..... 451/45, 374, 403, 451/419, 420, 193, 192, 321, 196, 203, 229; 76/82, 85; 125/3, 5; 144/364

[56] References Cited

U.S. PATENT DOCUMENTS

| | | | |
|---|---|---|---|
| 3,542,302 | 11/1970 | Salzamann, Jr. | 241/298 |
| 3,559,705 | 2/1971 | Salzmann, Jr. | 144/162 |
| 4,047,670 | 9/1977 | Svensson | 241/92 |
| 4,319,718 | 3/1982 | Snavely et al. | 451/419 |
| 4,340,099 | 7/1982 | Lomnicki et al. | 144/220 |
| 4,351,487 | 9/1982 | Haller et al. | 241/92 |
| 4,423,758 | 1/1984 | Haller et al. | 144/176 |
| 4,503,893 | 3/1985 | Demopoulos | 144/176 |
| 4,667,713 | 5/1987 | Wright | 144/231 |
| 4,694,995 | 9/1987 | Holmberg et al. | 241/92 |
| 4,712,597 | 12/1987 | Stringer | 144/176 |
| 4,771,718 | 9/1988 | Carpenter et al. | 144/176 |
| 4,805,408 | 7/1989 | Carpenter et al. | 144/241 |
| 4,887,772 | 12/1989 | Robinson et al. | 241/92 |
| 4,977,939 | 12/1990 | Depuy et al. | 144/176 |
| 4,997,018 | 3/1991 | Carpenter et al. | 144/241 |
| 5,183,089 | 2/1993 | Norlander et al. | 144/231 |
| 5,209,025 | 5/1993 | Martin et al. | 451/420 |
| 5,271,440 | 12/1993 | Bradstreet, Jr. et al. | 144/176 |
| 5,287,901 | 2/1994 | Matthews | 144/176 |
| 5,348,064 | 9/1994 | Nettles et al. | 144/176 |

*Primary Examiner*—Bruce M. Kisliuk
*Assistant Examiner*—Derris Banks
*Attorney, Agent, or Firm*—Walter C. Farley

[57] ABSTRACT

Sharpening the cutting edge of a chipper knife having a chip-breaking shoulder in its underside remote from the cutting edge apex which is integral with the chipper knife is effected by removing a layer of material of uniform thickness from the underside of the cutting edge and thereby removing the bluntness of a dulled cutting edge and forming a resharpened cutting edge having the same wedge angle as the cutting edge prior to resharpening.

7 Claims, 6 Drawing Sheets

Fig. 1.
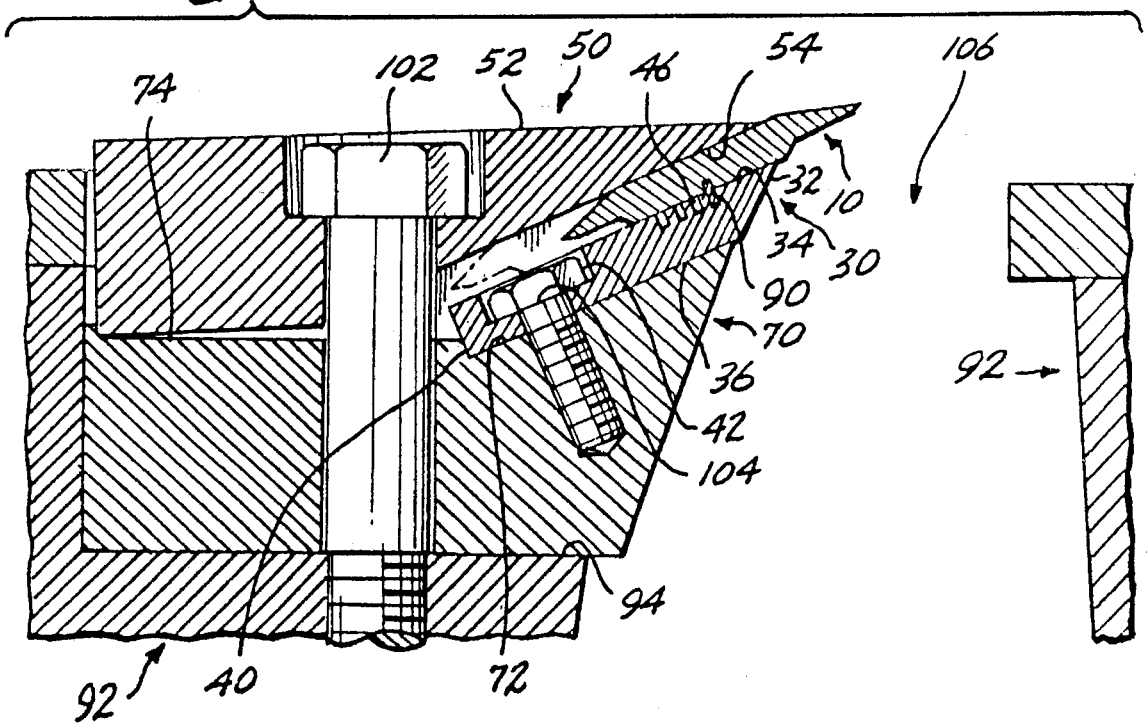
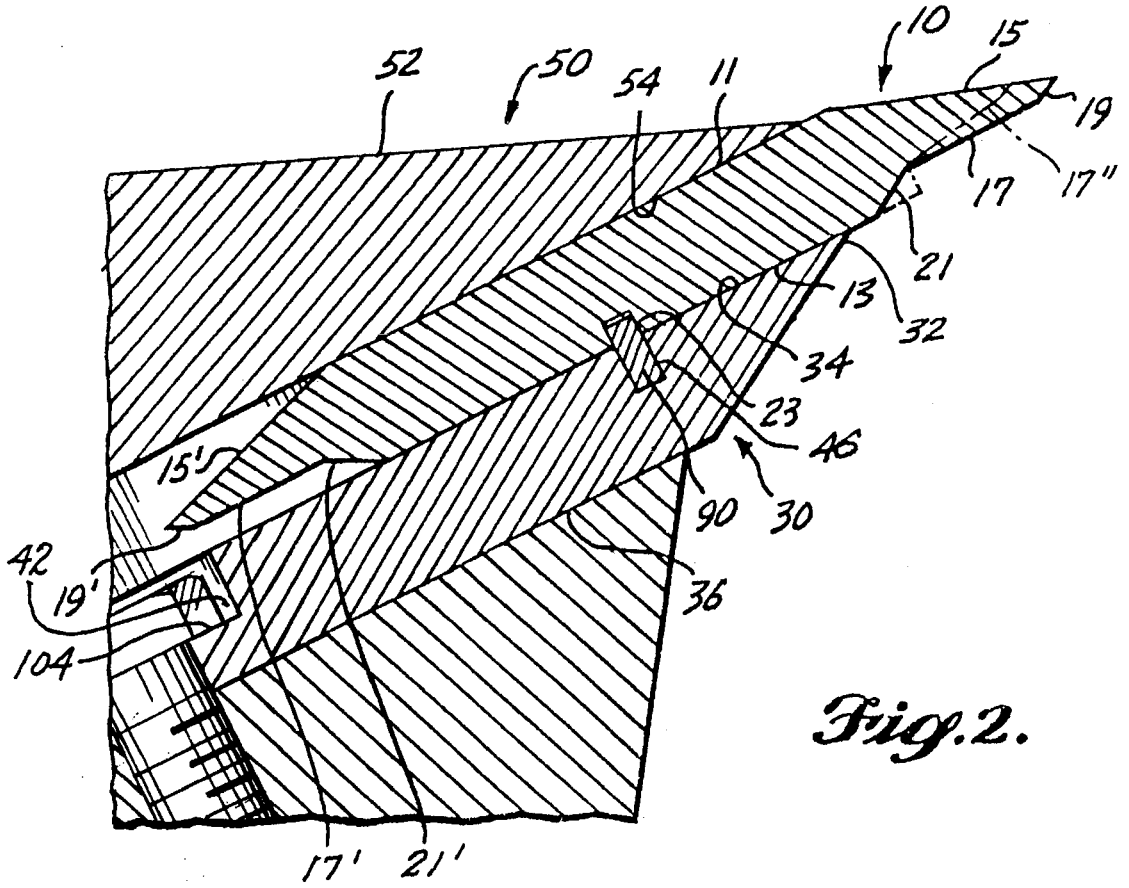
Fig. 2.

Fig. 5.
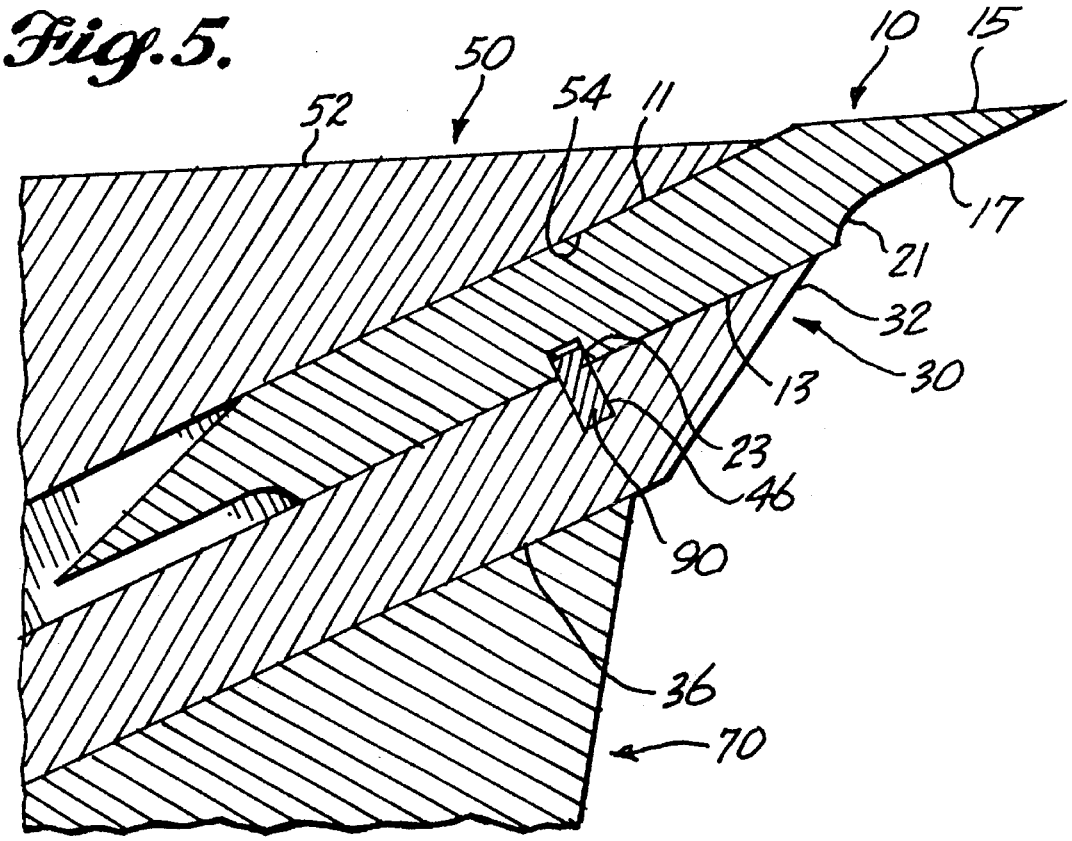
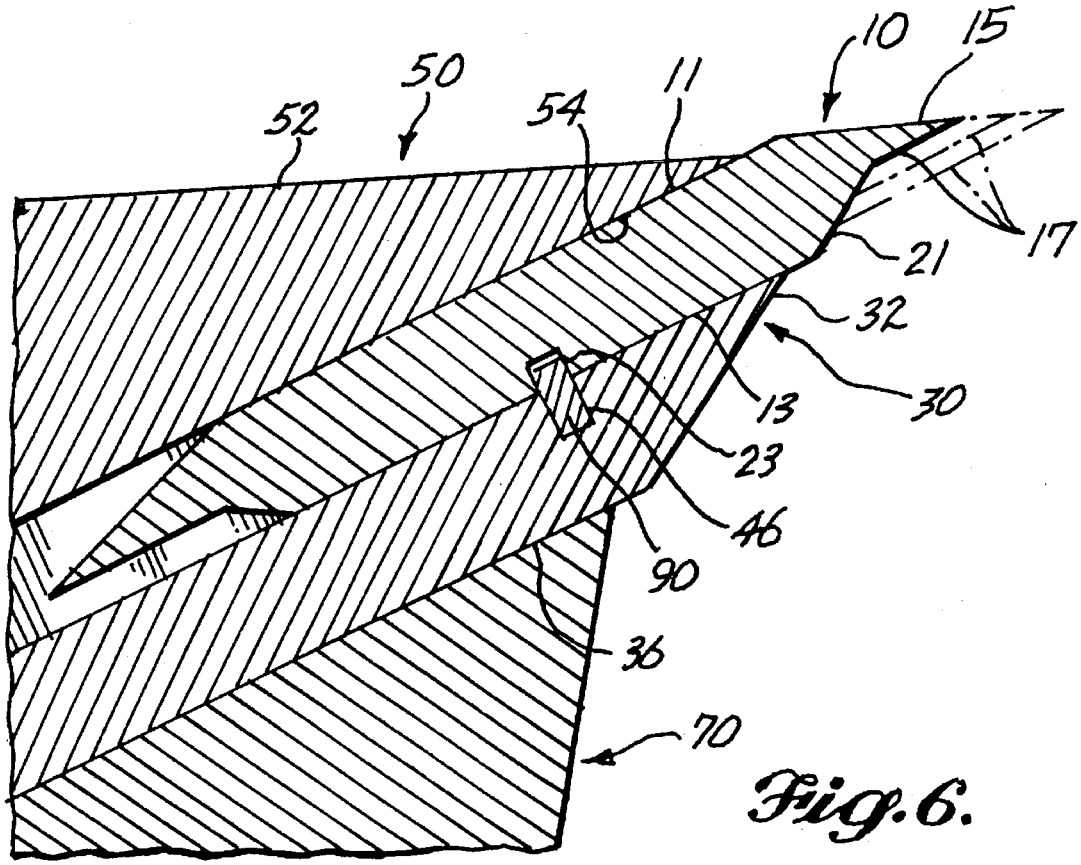
Fig. 6.

METHOD FOR SHARPENING A CHIPPER KNIFE

This application is a continuation-in-part of my patent application Ser. No. 08/058,866, filed May 10, 1993, for Chipper Knife, which is now U.S. Pat. No. 5,409,047.

BACKGROUND OF THE INVENTION

1. Field of the Invention

This invention relates to a method for sharpening knives used in wood chippers such as a rotatable disc type in which the disc carries a plurality of circumferentially spaced radial knives alongside chip-discharge openings through the disc.

2. Prior Art

Wood chippers having rotatable cutters, or drums, or rotatable chipping discs fitted with double-edged knives are known in the art.

A single resharpening of the knife blade, involving the removal of material from one or both of the edge surfaces forming the wedge cutting edges of a double-edged knife is often the only reshaping or resharpening of a knife blade before it is discarded.

One aspect of the geometry of chipper knives is that knives having a large wedge angle, i.e., the angle between the two surfaces converging to the cutting edge, remain sharper longer and therefore are more popular. However, the larger wedge angles are more likely to cut a chip by shearing the chip from the incoming material rather than by cleavage. More force is required to sever chips by shearing than by cleavage, and thus more power is required to operate a disc chipper having knives with larger wedge angles.

Another problem is the penetration of chip particles between the knife and the knife holding means beneath the knife, typically a counter knife, that can cause excessive pressure on the knife which may bend it outwardly sufficiently to hit the anvil.

SUMMARY OF THE INVENTION

The principal object of the invention is to provide a new method of sharpening chipper knives which is particularly valuable for resharpening various types of chipper knives so that a cutting edge can be reconditioned for use one or more times instead of being unusable after it has been dulled the first time by use.

A further object is to provide a chip deflector and chip breaker which is integral with a cutting edge of a chipper knife.

The invention provides a novel knife and knife-holding means for a chipper. The knife is double-edged, each cutting edge comprising an upper surface, preferably a standing bevel, and an undersurface, which surfaces converge and intersect to form a cutting edge. Additionally the knife includes a chip-deflecting surface forming the heel or part of the cutting edge undersurface remote from the cutting edge apex which constitutes a chip breaker that deflects and breaks chip material cut by the knife cutting edge. This chip breaker deflects the chips so as to prevent the penetration of chip particles between the knife and the knife holding means beneath the knife, such as a counter knife, and preferably so that the chips do not strike the knife holding means which decreases wear on the knife holding means.

BRIEF DESCRIPTION OF THE DRAWINGS

FIG. 1 is a cross section of a double-edged chipper knife and its associated holding means which knife has been narrowed by resharpening;

FIG. 2 is an enlarged cross section of a double-edged chipper knife similar to that shown in FIG. 1 and its associated holding means;

FIG. 5 is an enlarged cross section of a chipper knife similar that shown in FIG. 2 but having a slightly modified shape;

FIG. 6 is a cross section of a chipper knife like that shown in FIG. 2 but which has been resharpened;

DETAILED DESCRIPTION

Figure 3:
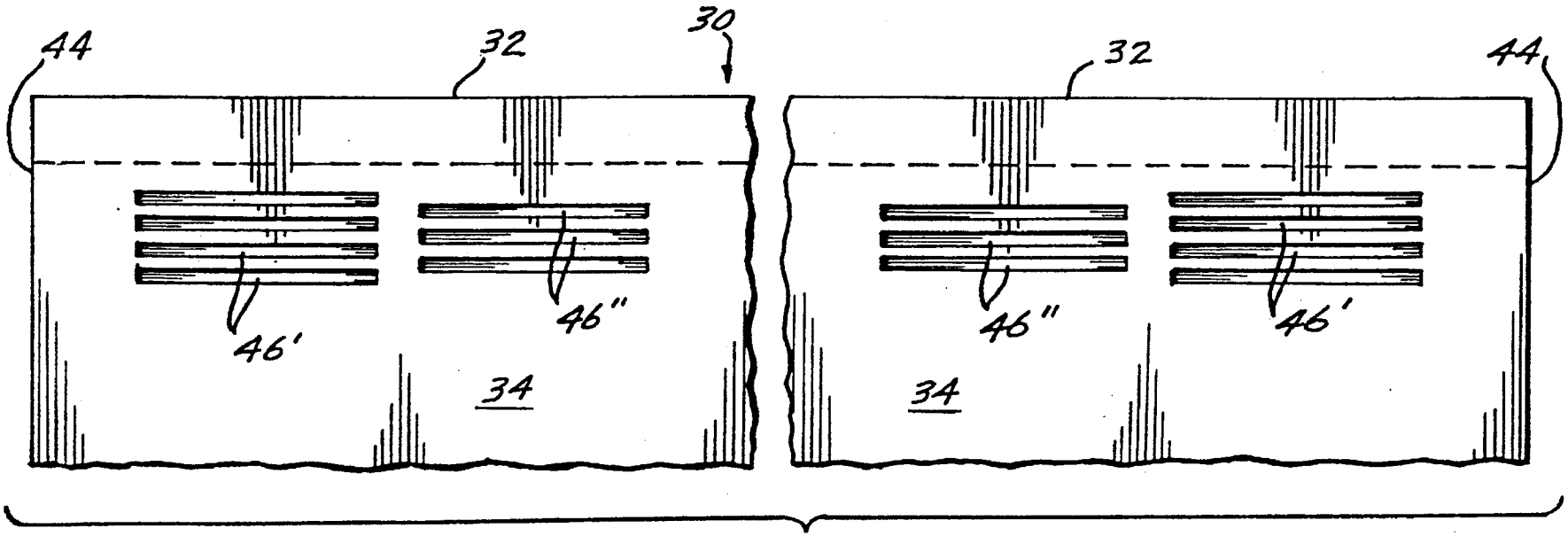
FIG. 3 is a partial top plan of the counter knife used in the knife holding means of FIG. 1.

A chipper knife sharpened according to the present invention is illustrated as being used in a disc type wood or log chipper in FIG. 1, but such a knife could be used in a drum chipper or rotary knife chipper. The materials to be chipped, such as logs, are fed at an angle to the rotating disc. The chips pass through radially elongated openings 106 in the disc 92 adjacent to the knives to be expelled from the chipper.

Knife assemblies are carried by the disc at circumferentially spaced locations. Each knife assembly includes a knife 10 elongated radially or a radial series of knife sections placed end to end, and knife holding means including knife seat 70, counter knife 30, and knife clamp 50. Each knife assembly is disposed in a recess 94 in disc 92 adjacent to a radially elongated opening 106 through the disc. The knife seat has an elongated body with a platform 72 thereon for placement of the counter knife 30, and a support 74 for the knife clamp 50. The platform 72 has in it a blind bore threaded to receive a fastener such as a cap screw 104 for mounting the counter knife.

The knife is held in position by the knife clamp 50 as shown in FIG. 1. The knife clamp has a knife engagement surface 54 contacting the knife top surface 11. The knife clamp is secured to the disc 92 by a fastener such as a screw 102 as shown in FIG. 1.

The counter knife 30 has a bottom surface 36 in contact with the knife seat platform 72, a top surface 34 for engagement by the bottom surface 13 of the knife body 10, an inner end 40 abutting a shoulder in the knife seat platform 72, a recess 42 to receive the head of the mounting screw 104, and longitudinal recesses 46 for placement of interlocking means or keys 90 engaged between knife 10 and counter knife 30.

The double-edged knife 10 comprises a radially elongated body the opposite edges of which are in-line cutting edges. The body of the knife has a top surface 11 and a bottom surface 13 as shown in FIG. 2. Each cutting edge has an upper surface 15 or 15', preferably a standing bevel at an obtuse angle to the top surface 11, which projects beyond and preferably is inclined slightly relative to the plane of the disc. Each cutting edge additionally has an underside or undersurface 17 or 17', which may be an under bevel The intersection of the convergent upper and under surfaces forms the cutting edge apex of the knife and the included angle between the upper surface and the under surface defines the wedge angle of the knife.

The knife further includes a chip breaker chip-deflecting surface 21 or 21' between the undersurface 17 or 17' and the bottom surface 13 of the knife which constitutes a heel or shoulder remote from the cutting edge of the knife. Such chip-deflecting surface 21 or 21' merges with the undersurface 17 or 17' of the knife cutting edge so as to form a depression which may include a reentrant angle as shown in FIG. 2 or a fillet as shown in FIG. 5.

The inclination of the undersurface or underside 17 or 17' in relation to the bottom surface 13 or the knife may vary from 0 degrees (shown as the full line 17 in FIG. 2) to 20 degrees (shown as the dot-dash line 17" in FIG. 2), making the included angle between the knife bottom and the cutting edge from 180 degrees to 160 degrees, and the inclination of the chip breaker shoulder or chip-deflecting surface 21 or 21' to the bottom surface 13 may vary from 20 degrees to 90 degrees, so that the included angle between the chip-deflecting surface and the bottom surface would be 160 degrees to 90 degrees as shown in FIG. 2, but should always be greater than the angle between the undersurface or underside 17 or 17' and the knife bottom surface 13 so that the surface 17 or 17' will be offset from the bottom surface 13 of the knife to form an undercut.

The purpose of the chip breaker and chip-deflecting surface 21 or 21' is to break apart chips cut by the cutting edge of the knife and to deflect the chips toward the discharge slot 106 and away from the beveled edge 32 of the knife holding means or counter knife beneath the knife 10 so as to prevent chip material from wedging into the joint between the knife and the counter knife beneath the knife. The knife holding means edge 32 is set back from the chip-deflecting surface 21 or 21' so as to minimize the chip material striking the knife holding means.

Additionally, the knife cutting edge can include a small tip under bevel 19 or 19' between the cutting edge upper surface 15 and the cutting edge principal undersurface 17 or 17' to increase the wedge angle of the knife locally at the apex of the cutting edge.

While, as stated above, the wedge angle of the knife cutting edge can be selected between the line 17 and the line 17" shown in FIG. 2 or the wedge angle of the knife cutting edge can be increased at the tip as indicated by the line 19, the cutting edge formed between the upper surface 15 and the undersurface 17 may be selected as the optimum or most effective wedge angle for a particular chipper knife. Under such circumstances it is desirable to be able to resharpen the chipper knife cutting edge without altering the original wedge angle. The type of resharpening shown in FIG. 4 does not change the cutting edge blade angle.

The degree of inclination of the chip-deflecting surface 21 or 21' could be altered during resharpening of the cutting edge and thus affect the breaking force and chip deflection provided by contact of the chips with such surface. The setback of the heel of the chip-deflecting surface from the cutting edge could also be altered independently of the degree of narrowing of the knife effected by sharpening of the cutting edge, or could be ground to maintain the same amount of setback after resharpened by removing material from the upper surface 15 of the cutting edge as illustrated in FIG. 4.

Figure 4:
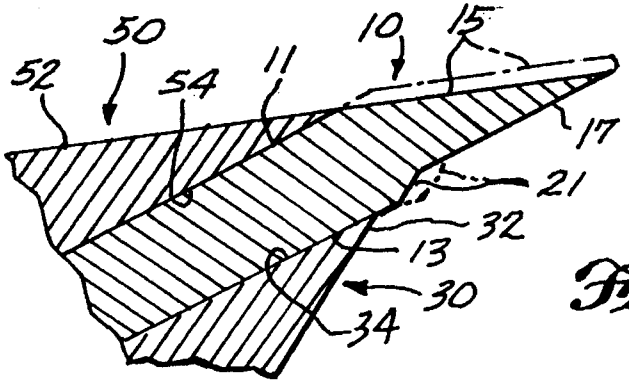
FIG. 4 is a enlarged cross section of a chipper knife cutting edge which has been resharpened.

Resharpening of the chipper knife as shown in FIG. 4 requires shifting the blade transversely to a new position after each resharpening. The grooves 46 in the top 34 of the counter knife 30 are preferably of rectangular cross section and are arranged in sets. Typically each outer set closer to the ends 44 of the counter knife includes grooves 46' and each inner set farther from the ends 44 of the counter knife includes grooves 46" as shown in FIG. 3. The grooves 46' and 46" of both sets are parallel to the edge 32 of the counter knife 30 underlying the knife and to the main longitudinal axis of the counter knife. The grooves 46" of the inner set are staggered in relation to the grooves 46' of the outer set of grooves. The distance between adjacent grooves of each set can be very small, such as approximately ⅛ of an inch on centers, and the distance between the centers of the grooves in one set and the centers of the grooves in the other set transversely of the groove length will be 1/16 of an inch as shown in FIG. 3.

The different sets of grooves 46' and 46" represent different positions for the knife 10 that is interlocked with the counter knife 30 by keys 90 fitting in grooves 23 in the bottom 13 of the knife so as to enable the knife to be moved edgewise progressively corresponding to small amounts of material, about 1/16 of an inch in width incrementally, removed from the knife cutting edge during resharpening as illustrated in FIG. 4 by grinding the upper surface 15 of the cutting edge. The original dull cutting edge is shown in dot-dash lines and the resharpened cutting edge is shown in full lines.

Following resharpening of the knife, the interlocking means or keys 90 would be repositioned in the grooves of the counter knife 30 shown in FIGS. 1 and 3 to advance the now narrower knife by moving the knife transversely of to its longitudinal axis and of its cutting edge.

After a knife edge has been resharpened, the knife will be assembled with the counter knife as shown in FIG. 1 and two keys 90 will be placed in the knife grooves 23 and in corresponding grooves 46' of the outer sets of counter knife grooves or in corresponding grooves 46" of the inner sets of counter knife grooves in the top surface 34 of the counter knife 30, depending upon the desired degree of projection of the knife edge beyond the counter knife edge 32 as indicated in FIG. 1 and FIG. 4. Initially the keys will be placed in grooves 46' or 46" farther from the edge of the counter knife, and the keys will be moved toward the counter knife edge progressively, first in grooves 46', then in grooves 46", then back to adjacent grooves 46', until the knife edge has been resharpened as many times as there are grooves in a set 46' and in a set 46". At that point, the keys 90 will be located in the grooves 46' closest to the edge 32 of the counter knife 30 as shown in FIG. 1.

The dash-dot lines extending to the left of knife 10 in FIG. 1 represent the profile of a new knife prior to any use or regrinding. Subsequent regrinds make the knife narrower and narrower as both edges are resharpened until it is reduced to the knife 10 shown in solid lines in FIG. 1. Further shifting of the blade edgewise is not possible after the blade has been resharpened to the full line condition shown in FIG. 1.

Once the edges of the knife shown in solid lines in FIG. 1 are completely dulled, the knife is discarded, or the cutting edge can be resharpened further without requiring the knife to be shifted edgewise, by utilizing the resharpening technique illustrated in FIG. 6 where material is removed only from the underside of the cutting edge so that the degree of undercut formed by the undersurface 17 has been increased without changing the wedge angle between the upper surface and the undersurface 17.

In such resharpening, the dullness of the cutting edge is removed without the necessity of removing any material from the upper surface 15 of the cutting edge as in the type of resharpening illustrated in FIG. 4. In such resharpening a uniform layer of material is removed, preferably by grinding, in making or deepening the undercut so that the wedge angle of the cutting edge between the upper surface 15 and the new undersurface 17 is the same as the wedge angle before such resharpening. In this resharpening operation, the width of the upper surface 15 is reduced to some extent, but such width reduction does not adversely affect the effectiveness of the cutting edge and does not require edgewise advancing of the cutting edge after being resharpened in this manner. Such resharpening operation has simply reduced the extent of projection of the cutting edge of the knife beyond the body of the knife. In FIG. 6, the original undersurface of the knife cutting edge and the new undersurface after the first resharpening using this technique are shown in dot-dash lines, and the cutting edge resharpened for the second time using this technique is shown in full lines.

Figure 7:
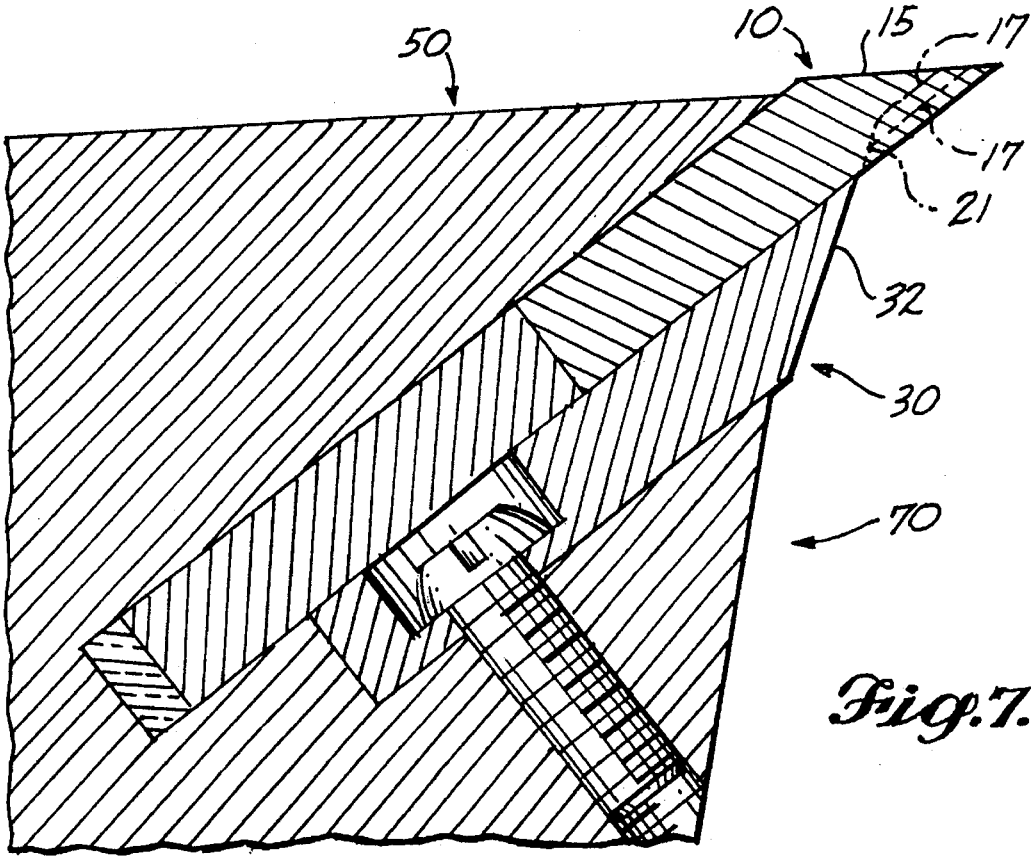
FIG. 7 is a cross section of a single-edged chipper knife and its associated holding means.

In FIG. 7 a single-edged chipper knife is shown. The shape of the cutting edge of this chipper knife before being resharpened is similar to the shape of the cutting edges of the chipper knife shown in Salzmann, Jr. U.S. Pat. No. 3,542,302, issued Nov. 24, 1970. The knife of FIG. 7 has been resharpened in conventional fashion by grinding back only the upper bevel 15 and advancing the chipper knife transversely of its length to the right. A filler plug P of Babbitt metal has been inserted into the space thus produced between the inner edge of the knife and the bottom of the knife-holding socket to back the knife against inward movement resulting from the thrust produced on the cutting edge by its repeated impact with wood to be cut.

By utilizing the technique of the present invention, the knife cutting edge can be resharpened without requiring the knife to be shifted edgewise transversely outward as discussed in connection with FIG. 6. In such resharpening, material is removed only from the underside of the cutting edge to form a new undersurface 17 indicated by dot-dash lines in FIG. 7 with a chip-deflecting and chip breaker shoulder 21 at the end of the undercut remote from the cutting edge so that the cutting edge has a profile such as shown in FIG. 2. Moreover, in thus resharpening the cutting edge, the bluntness can be removed at least twice and perhaps three times by deepening the undercut successively as indicated by the dot-dash lines in FIG. 7.

Figure 8:
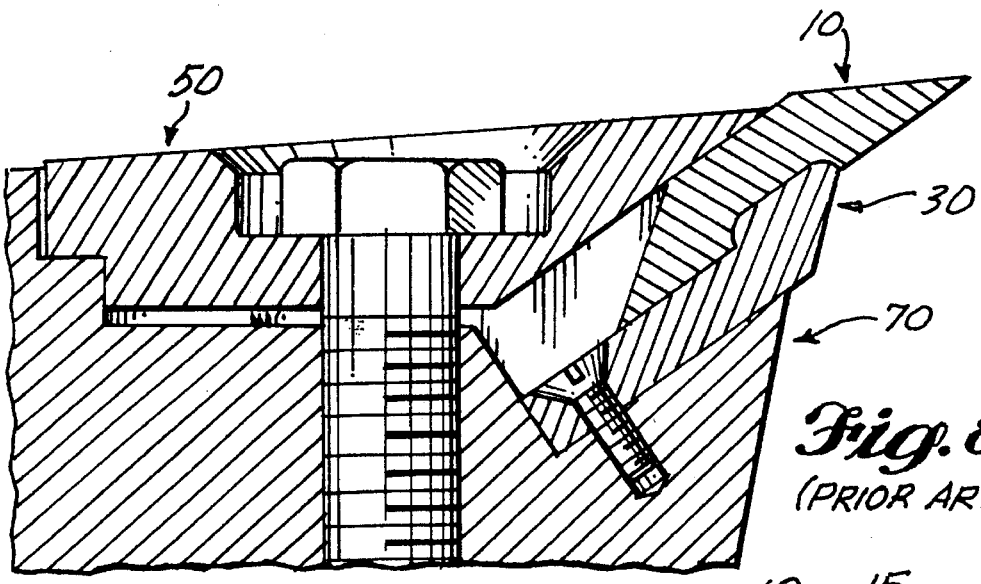
Fig. 8. (PRIOR ART)
FIG. 8 is a cross section of a prior art double-edged chipper knife and its associated holding means.

FIG. 8 shows a different prior art type of double-edged chipper knife like that shown in Carpenter et al. U.S. Pat. No. 4,771,718, issued Sep. 20, 1988, the Carpenter et al. U.S. Pat. No. 4,850,408, issued Jul. 25, 1989 and the Carpenter et al. U.S. Pat. No. 4,997,018, issued Mar. 5, 1991. It has not been possible heretofore to re sharpen the in-line cutting edges of this type of chipper knife because, after material was removed from the upper surface of a cutting edge in the manner shown in FIG. 4 of this application, the type of knife holder used prevented the knife from being shifted edgewise to raise the cutting edge to its original relationship to the clamp which holds the chipper knife in place. Consequently the chipper knife could not be repositioned into a new effective cutting position after such resharpening.

Figure 9:
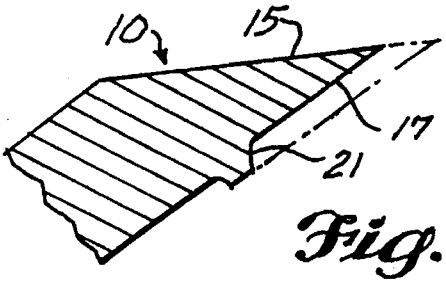
FIG. 9 is an enlarged fragmentary cross section of a portion of the chipper knife shown in FIG. 8 which has been resharpened once.

Each cutting edge of a chipper knife of the type shown in FIG. 8 can, however, be resharpened by utilizing the process of the present invention by undercutting the cutting edge to provide the recessed undersurface 17 shown in FIG. 9. To provide such an undercut, a layer of material of uniform thickness between the solid line 17 indicating the resharpened undersurface and the original undersurface shown in solid lines in FIG. 7 and FIG. 8 and in dot-dash lines in FIG. 9.

While such resharpening of the chipper blade by undercutting the cutting edge removes the dulled blunt tip of the cutting edge, the upper surface 15 of the cutting edge is not narrowed sufficiently to detract appreciably from the cutting effectiveness of the resharpened cutting edge, even though the chipper knife has not been advanced edgewise. Moreover, such resharpening provides a chip breaker shoulder 21 which improves the operation of the knife.

Figure 10:
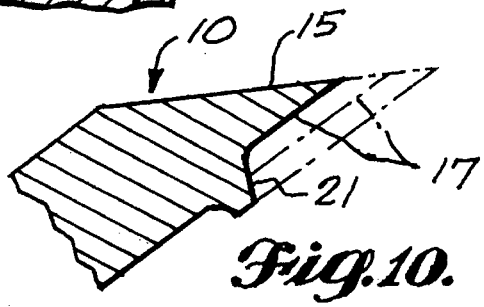
FIG. 10 is a similar cross section of a cutting edge of the chipper knife which has been resharpened twice.

By using the same technique, the cutting edge of this type of chipper knife can be resharpened a second time by removing further material from the first resharpened cutting edge shown in FIG. 9 to provide the cutting edge shown in FIG. 10 in which the second resharpened undersurface 17 is shown in solid lines and the two previous undersurfaces are shown in dot-dash lines. Thus, instead of the double-edged chipper knife of FIG. 8 being discarded when both cutting edges have been dulled, each of the edges can be resharpened at least twice by utilizing the present technique to increase greatly the useful life of the chipper knife.

Because the layer of material removed from the undersurface of the cutting edge is of uniform thickness in each instance, the wedge angle of the resharpened chipper knife cutting edge is the same as it was before even after such cutting edge has been resharpened twice.

Figure 11:
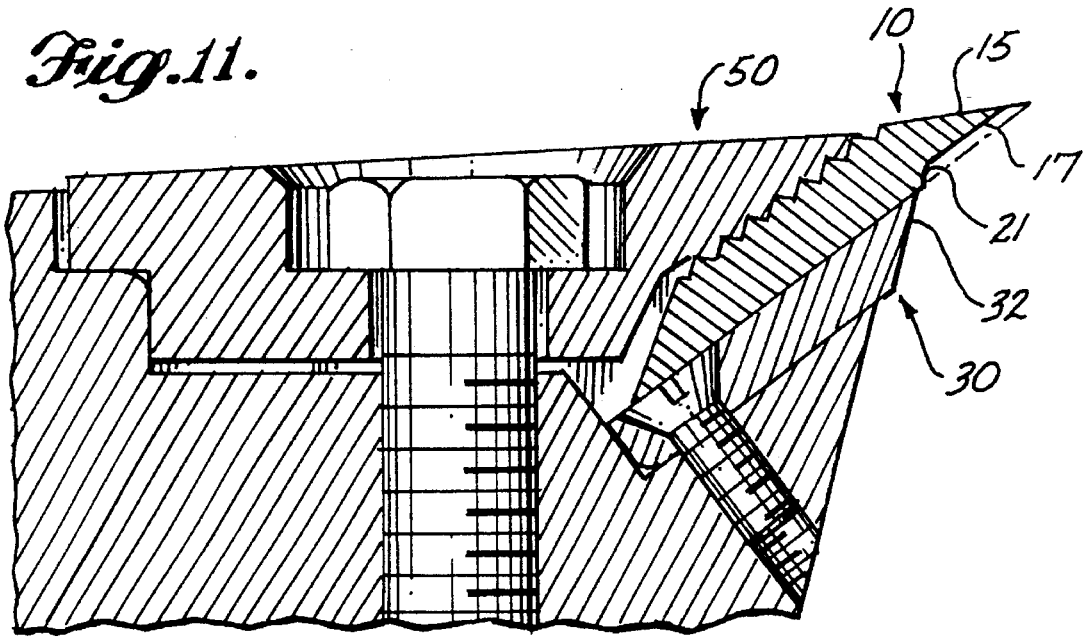
FIG. 11 is a ross section of a double-edged chipper knife and its holding means of a different type one edge of which has been resharpened once.

FIG. 11 shows another double-edged chipper knife having in-line cutting edges similar to the cutting edges of the chipper knives shown in the Carpenter patents referred to above, but this chipper knife assembly has a different type of knife-holding arrangement. This figure shows one of the cutting edges having been resharpened by removing a layer of material from the underside of the cutting edge of uniform thickness so that the resharpened cutting edge has the same wedge angle as the original cutting edge, the original undersurface being indicated in dot-dash lines. Also, such undercut resharpening of the cutting edge forms the shoulder 21 functioning as a chip-deflecting surface and chip breaker adjacent to the end 32 of the counter knife 30.

Figure 12:
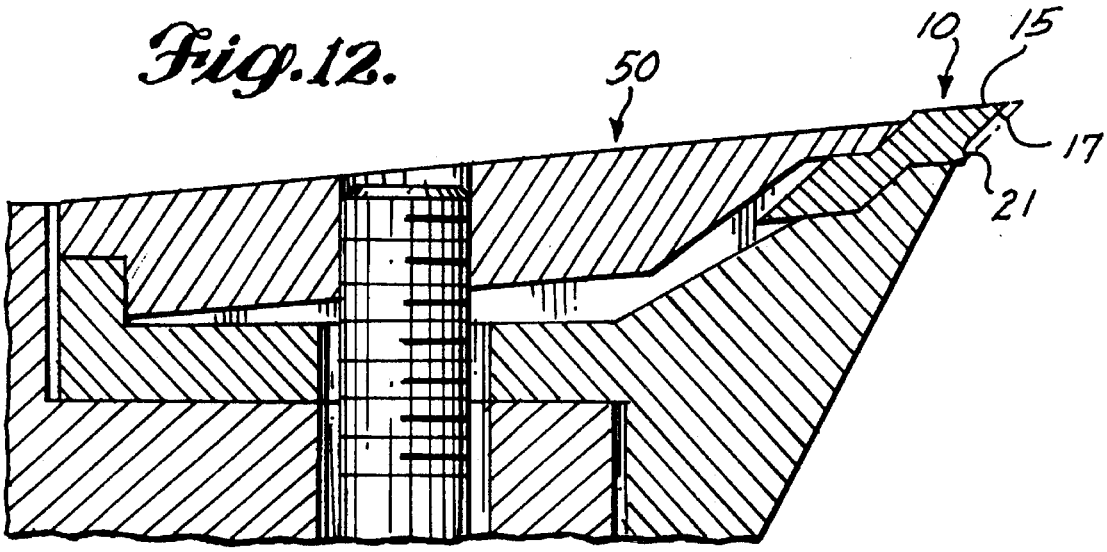
FIG. 12 is a cross section of a double-edged chipper knife and its associated holding means of still a different type, one cutting edge of which has been resharpened once.

The chipper knife and its associated holding means shown in FIG. 12 is of the type shown in Svensson U.S. Pat. No. 4,047,670, issued Sep. 13, 1977 and in Holmberg et al. U.S. Pat. No. 4,694,995, issued Sep. 22, 1987. The holding means for the offset cutting edge chipper knife of this type does not enable the knife to be shifted edgewise relative to the knife-holding means as required when a knife edge is sharpened by the technique illustrated in FIG. 4 and, consequently, such knives have not been resharpened after both edges have become dull. The resharpening method of the present invention enables each of the cutting edges of such a knife to be resharpened at least once, and perhaps twice or three times depending upon the amount of material removed from the underside of the cutting edge during each resharpening.

FIG. 12 shows one of the offset cutting edges resharpened by having removed from its underside a layer of material of uniform thickness so that the wedge angle of the cutting edge is the same after it has been resharpened as it was originally. Moreover, the undercutting of the cutting edge which forms the new undersurface 17 also forms the heel 21 which provides a chip-deflecting surface and chip breaker as discussed in connection with the resharpened cutting edges of the chipper knives described above. While FIG. 12 shows only one cutting edge of the knife resharpened, the other cutting edge of the knife could be resharpened in a similar manner.

Figure 13:
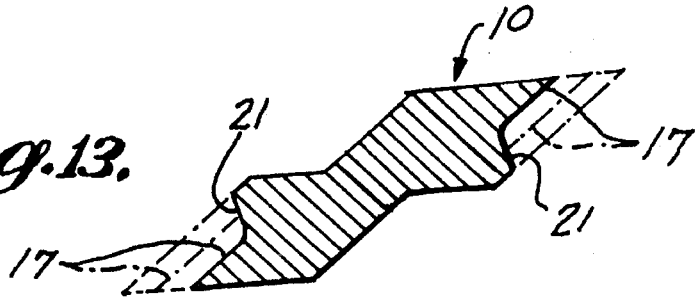
FIG. 13 is an enlarged cross section of the same type of chipper knife which has been resharpened twice.

FIG. 13 shows both cutting edges of an offset double-edged chipper knife of the type shown in FIG. 12 resharpened for a second time to provide the undersurface 17 shown in full lines. The locations of the original undersides of the cutting edges and of the undersides of the cutting edges after being resharpened for the first time are indicated in dot-dash lines. It will be noted that in none of these resharpening operations is any material removed from the upper side 15 of the cutting edge. By using the resharpening technique of the present invention, it may be possible to resharpen a chipper knife cutting edge twice or three times, depending upon how much material it is necessary to remove to remove the bluntness of the dulled cutting edge in each instance. Also, it may be possible to increase the number of times such a chipper knife cutting edge is resharpened by increasing the wedge angle of the cutting edge to some extent, but it is preferred to remove a layer of material of uniform thickness from the underside of the cutting edge during a resharpening operation so as not to change the wedge angle of the cutting edge.

Figure 14:
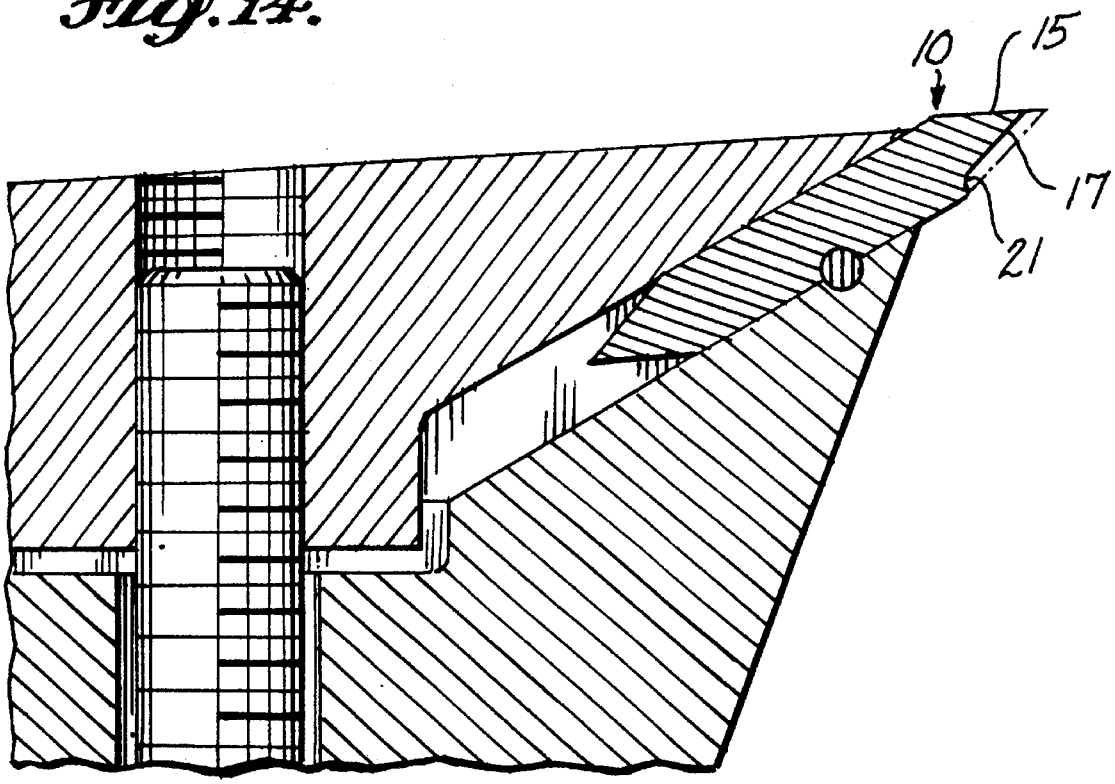
FIG. 14 across section of a double-edged chipper knife and associated holding means of a still different type, one cutting edge of which has been resharpened.

FIG. 14 shows a double-edged in-line chipper knife and its associated holding means of the type shown in Haller et al. U.S. Pat. No. 4,423,758, issued Jan. 3, 1984, Demopoulos U.S. Pat. No. 4,503,893, issued Mar. 12, 1985, and Haller U.S. Pat. No. 4,351,487, issued Sep. 28, 1982. In this type of cutting edge, the included angle between the bottom of the knife and the underside of the cutting edge is less than 180 degrees, perhaps 160 degrees or 162 degrees, for example. When such a cutting edge is resharpened according to the present invention, again a layer of material of uniform thickness is removed from the underside of the cutting edge, as indicated in FIG. 14 but the layer removed again does not extend to the bottom of knife. Instead the resharpened cutting edge terminates in a shoulder 21 so that the location of the cutting edge heel on the bottom of the knife is not appreciably changed by the resharpening and it is not necessary to shift the knife edgewise relative to its holding means after such resharpening.

Figure 15:
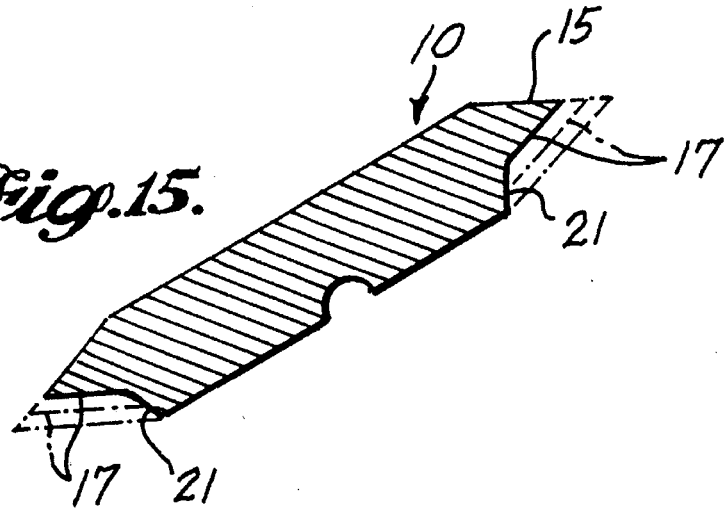
FIG. 15 is an enlarged cross section of a fragmentary portion of the same type of chipper knife showing both cutting edges having been resharpened twice.

Again, the resharpening operation can be effected at least twice and perhaps three times for each cutting edge, as indicated by the dot-dash lines in FIG. 15 which shows a cutting edge that has been resharpened twice. Both of the in-line cutting edges of this double-edged knife can be resharpened in a similar manner to extend the life of the chipper knife, and, again, the original wedge angle of the knife is preserved in the resharpening operation.

I claim:

1. A method of resharpening a dulled cutting edge of a chipper knife having an upper surface and an underside converging to a cutting edge apex which comprises undercutting the underside of the cutting edge by removing material and thereby removing the bluntness of the dulled cutting edge and forming a chip breaker shoulder remote from the cutting edge apex which is integral with the chipper knife.

2. The method of resharpening defined in claim 1, including removing a layer of material from the underside of the cutting edge of substantially uniform thickness and thereby preserving in the resharpened cutting edge substantially the same wedge angle as the cutting edge had prior to being resharpened.

3. The method of resharpening defined in claim 1, including resharpening a cutting edge which has been previously sharpened to provide a shoulder remote from the cutting edge apex which comprises removing a further layer of material from the underside of the cutting edge and thereby increasing the width of the shoulder.

4. The method of resharpening a chipper knife defined in claim 2, which chipper knife is adapted to be held in a chipper by supporting means, including resharpening a cutting edge which has been sharpened previously by removing a further layer of material from the underside of the cutting edge and thereby reducing the width of the upper surface and of the underside of the cutting edge between the shoulder and the cutting edge apex, whereby it is unnecessary to reposition the chipper knife edgewise relative to its supporting means after such resharpening.

5. A method of resharpening a dulled cutting edge of a chipper knife having an upper surface and an underside converging to a cutting edge apex and having a chip breaker shoulder in the underside remote from the cutting edge apex which comprises removing material from the upper side of the cutting edge and thereby removing the bluntness of the dulled cutting edge and removing material from the cutting edge underside shoulder to maintain the cutting edge underside approximately the same width as the width of the cutting edge underside prior to the cutting edge being resharpened.

6. A method of resharpening a dulled cutting edge of a chipper knife having an upper surface and an underside converging to a cutting edge apex which comprises forming an undercut having a chip-breaking shoulder remote from the cutting edge apex which is integral with the chipper knife by removing material only from the underside of the cutting edge and thereby removing the bluntness of the dulled cutting edge.

7. The method defined in claim 6, including further resharpening the cutting edge by removing additional material from the underside of the cutting edge to deepen the undercut in the underside of the cutting edge.

* * * * *